United States Patent [19]

Brophy

[11] Patent Number: 4,757,573

[45] Date of Patent: Jul. 19, 1988

[54] CHIMNEY FLUE SCRAPING APPARATUS

[75] Inventor: Richard Brophy, Blackduck, Minn.

[73] Assignee: Ralph Brophy, Fayetteville, Ark.

[21] Appl. No.: 64,231

[22] Filed: Jul. 19, 1987

[51] Int. Cl.[4] ..... F23J 3/00

[52] U.S. Cl. ..... 15/243; 15/249; 15/163; 15/104.19

[58] Field of Search ..... 15/242, 243, 249, 162, 15/163, 104.18, 104.19, 165

[56] References Cited

U.S. PATENT DOCUMENTS

| | | | |
|---|---|---|---|
| 1,847,364 | 3/1932 | Rugard | 15/242 |
| 2,077,731 | 4/1937 | Aaby | 15/243 |
| 2,602,177 | 7/1952 | Aho | 15/163 |
| 4,085,477 | 4/1978 | Anderson | 15/243 |

*Primary Examiner*—Harvey C. Hornsby
*Assistant Examiner*—K. L. O'Leary
*Attorney, Agent, or Firm*—Robert R. Keegan

[57] ABSTRACT

There is disclosed a chimney cleaner comprising a frame of rectangular cross-section narrower than the internal dimension of the chimney flue to be cleaned and having a substantial vertical height with spring-loaded pivotal flue side-scraping blades mounted to swing outwardly and upwardly from the sides of the frame to firmly contact and scrape the sides of a flue; preferably there are four blades with two oppositely disposed blades displaced vertically from the other two oppositely disposed blades whereby the blades may be substantially the full width of the flue and yet not interfere one with the other. Blade holders for the blades have arms extending toward the center of the frame and a central shaft has camming plates which act against the arms to retract the blades for lowering the apparatus into a flue; the shaft is vertically displaced by a pull on the rope connected thereto releasing the arms from the camming plates and allowing the adjustable-force, spring-loaded blades to spring out against the interior walls of the flue. As the apparatus is drawn up the flue the blades scrape creosote, soot and other deposits from the interior walls of the flues. The apparatus or the blades, or both, may be sized and shaped to accommodate different sizes and shapes of flues and the apparatus may be employed with ceramic flue tiles, metal pipe or other forms of chimney structure.

10 Claims, 5 Drawing Sheets

CHIMNEY FLUE SCRAPING APPARATUS

The present invention relates to apparatus for cleaning chimneys and particularly chimneys formed of rectangular or circular ceramic flue tile. It has long been known that chimneys accumulate deposit of soot, creosote and other materials which not only impair the efficiency of the chimney, but also may present a serious fire hazard. Numerous instruments in the form of scrapers, brushes and the like have been proposed for cleaning chimneys, including some which employ spring-loaded arms with scraping elements on the ends adapted to vigorously scrape the inside wall of flue tiles when drawn up or, in some cases, down the chimney flue by means of a rope or the like. See for example U.S. Pat. No. 1,315,849 to Frank T. MacDonald for "Flue or Chimney Cleaning Apparatus" granted Sept. 9, 1919; U.S. Pat. No. 518,638 to Edward D. Weston for "Flue Cleaner" granted Apr. 24, 1894; U.S. Pat. No. 1,543,018 to Richard Le Feuvre for "Flue Cleaner" granted Apr. 8, 1924; and U.S. Pat. No. 4,085,477 to Charles H. Anderson for "Flue and Chimney Cleaners" granted Apr. 25, 1978.

Such previous apparatus has, however, suffered from deficiences such that the objective of quickly and thoroughly cleaning a chimney flue, preferably with one pass of the chimney cleaner, could not ordinarily be accomplished. Several passes of the prior art devices would be required and even then the cleaning of the flue tile in the rectangular corners or around tile joints would leave substantial deposits which could be hazardous, or at best would substantially shorten the time until recleaning would be necessary. Apparatus according to the present invention has improved features which overcome the deficiency of prior art scraper type flue cleaning apparatus, and it makes possible more rapid and effective cleaning of the chimney flue than heretofore possible.

An important time saving feature of the present apparatus involves the manner in which the scraping blades are cocked or retracted to allow the cleaning apparatus to pass easily down the flue (the operation is directed and controlled from the top of the chimney). Camming plates which hold the scraper blades in retracted position are shaped and arranged to release the spring-loaded blade holding elements upon a sharp pull of the rope connected to the central shaft of the mechanism. Accordingly, no access to the apparatus from the bottom of the chimney is required to deploy the blades to an active position, nor is it necessary to lower the apparatus all the way to the bottom of the chimney to activate the blades. Thus the apparatus can be lowered to any position in the chimney flue and the blades may be released to commence the upward cleaning operation from that point.

The present apparatus also has the capability of cleaning the entire inner surface of the flue with one pass because the two separate pairs of blades are vertically offset and can reach the corners or the entire surface of the flue without mutual interference. The pressure exerted by the scraping blades on the sides of the flue is readily adjustable by varying the spring-loading, and the scraping blades are removable for replacement or to permit different types of blades best adapted to particularly flue tile configurations or problem situations.

Some variation in the internal dimensions of the flue tiles to be cleaned may be accommodated by blade pivoting action of the apparatus itself and further variation may be accommodated by changes in the demountable blades. Gross differences in the size of flue tile is accommodated by making the frame of the apparatus larger or smaller or otherwise scaling the apparatus to the size of flue tile which it is designed to clean. Although the apparatus is particularly adapted to deal with the difficulties encountered with ceramic flue tile lined chimneys, it is also adaptable to use with round metal chimney pipe, preferably by employing soft-edge blades particularly adapted to such use.

The present apparatus is also arranged to be used as a pick-up tool or retriever by employing it in an inverted position where the rope attachment ring is changed to a position which would normally be the bottom of the apparatus.

The apparatus is also adapted to cleaning excess mortar from the interior of a chimney under construction to provide a particularly smooth interior flue surface less likely to collect deposits and more efficient in operation.

In addition to providing the above advantages and features it is an object of the present invention to provide a chimney cleaner with four blades supported by respective arms urged outwardly from a central frame so that chimney cleaning apparatus is provided, which may be drawn upward through ceramic flue tiles or the like to scrape soot, creosote, or other residue from the interior surface of the chimney.

It is another object of the present invention to provide such chimney cleaning apparatus wherein the blade retaining arms may be retracted and cocked to facilitate downward entry of the apparatus in the chimney flue while supported by a rope from the top of the chimney.

It is still another object of the present invention to provide such chimney cleaning apparatus wherein the edges of the four blades define a square or rectangle conforming to the shape of the interior of a rectangular ceramic chimney flue and are dimensioned and arranged to contact and scrape substantially the entire interior surface of a rectangular flue tile when being drawn upward through the chimney.

Other objects and advantages of the invention will be apparent from consideration of the following description in conjunction with the appended drawings in which.

Figure 1:
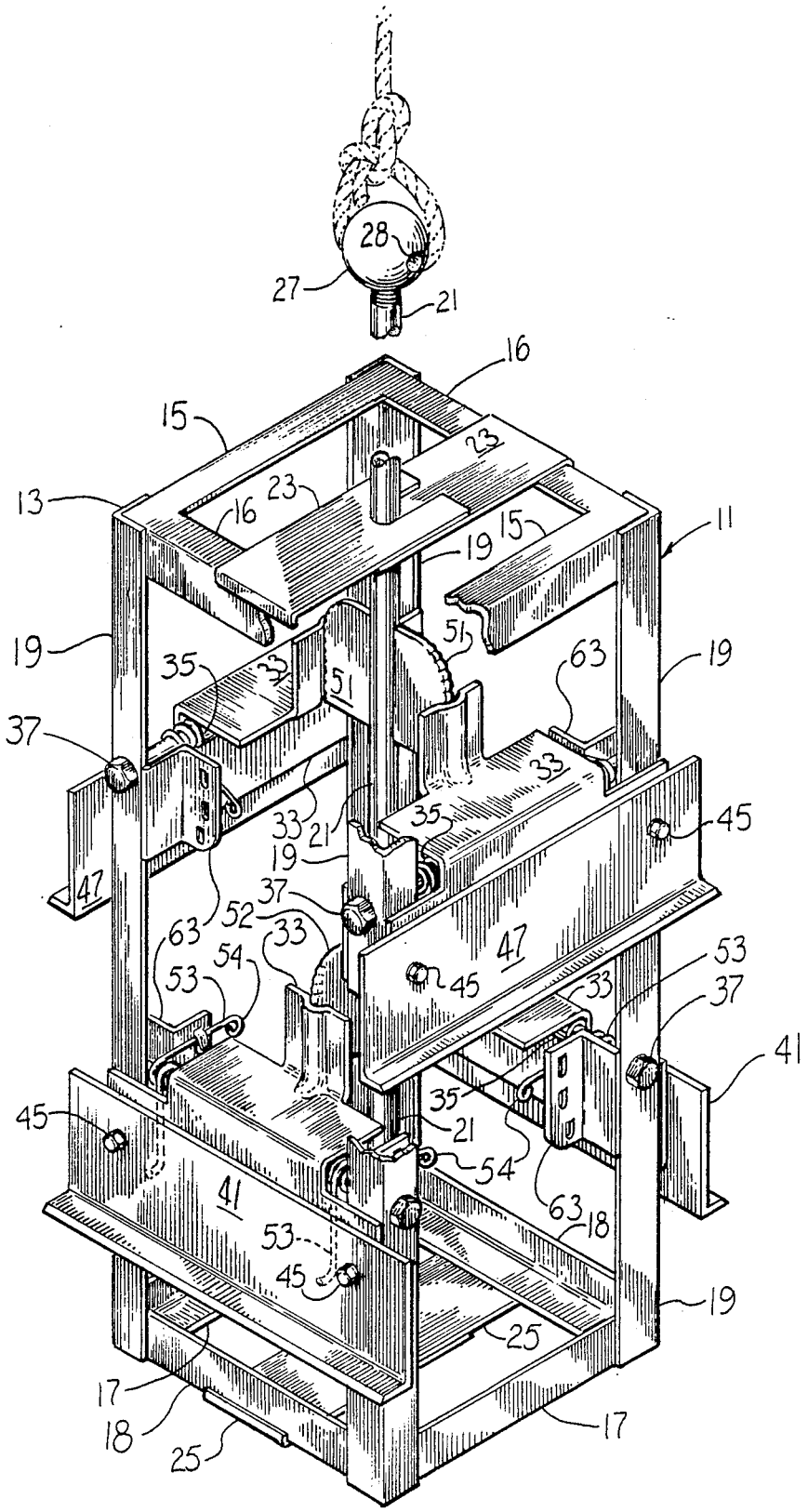
FIG. 1 is an isometric view of chimney flue scraping apparatus according to the invention.

Referring now to the drawings, and particularly to FIG. 1, a chimney flue scraping apparatus 11 having a frame 13 generally in the shape of a rectangular parallelopiped.

The frame 13 may be formed of steel bars and/or angles formed into a rectangular cage by welding or otherwise and as shown, is formed by upper bars 15 and 16 together with lower bars 17 and 18 plus four vertical angle elements 19. The exact shape and form of the frame 13 is subject to variation, but the case-like construction shown is of relatively light weight and gives proper structural support for the various other elements of the apparatus. A shaft 21 is mounted centrally in the frame 13 for limited vertical sliding movement relative thereto by means of an upper plate 23 and a lower plate 25, each having holes therein to accept the shaft 21.

The shaft 21 has a ball 27 threadedly engaged at the top thereof. The ball 27 has an opening 28 therethrough through which may be passed a rope, cable, or chain for lowering the cleaning apparatus 11 into the chimney flue. The ball 27 is convenient for manipulating the shaft 21, but a ring or other means would suffice for attachment of a cable or the like.

The lower end of the shaft 21 is provided with a threads 29 so that the ball 27 may be removed from the top and attached to the bottom of the shaft 21 to carry out certain functions which will later be explained. A collar 31 on the lower portion of the shaft 21 prevents separation of the shaft 21 from the frame 13 while permitting substantial vertical movement therebetween.

Arms 33 are provided with a bearing elements 35 which rotatably engage the shanks of bolts 137 mounted horizontally between the angle elements 19. The arms 33 are thus mounted for pivotal movement about a horizontal axis which, in operation of the apparatus, will be parallel to a side wall of a rectangular flue tile.

A blade mounting plate 41 is integrally formed on the end of each of the arms 33, and is provided with holes 43 tapped for bolts 45, or other fasteners adapted to secure blades 47 to the plates 41.

The plates 41 and the blades 47 attached thereto are free to pivot through an angle of about 90° or less, but are not freely rotatable because the plate 41 is wider than the space between the adjacent angle elements 19. Upper camming plates 51 and lower camming plates 52 are welded to, or otherwise secured to, the shaft 21, and may be caused to engage the inward portions of the arms 33 as shown in FIG. 1 with the result that the blades 47 are retracted to a substantially vertical position so that the maximum dimension of the apparatus is substantially less than the inside dimension of the flue tile with which it is to be used.

When the arms 33 are not engaged by the camming plates 51 they are urged to rotate the blades 47 outwardly by a coil springs 53. The springs 53 are positioned by the bolts 37 which pass therethrough and one end of the springs 53 engage the plates 41 and holes 55 are provided to hold the spring ends in position. The upper ends of the springs 53 may be retained by one of tabs 57, 59 or 61 on brackets 63 mounted on respective angle elements 19. The spring ends are shown retained in the tabs 57 in FIG. 1. This tab provides the least spring force for the arms 33 whereas the tabs 59 and 61 provide increasing amounts of spring force when the spring end is secured in one of those tabs. The ends of the springs 53 have a loop 54 therein to facilitate relocation of the spring end in one of the tabs 57, 59 or 61. The diameter of the spring wire, the number of turns, etc., may be determined to provide a desired working force at the end of the blades 47, which force would typically be in a range of from 1 to 20 pounds. By way of example, one might construct the spring and arrange the tabs 57, 59 and 61 to provide working forces of 2, 5 and 8 pounds respectively.

FIGS. 3 through 6 are schematic drawings illustrating positions of the cleaning apparatus as it is prepared for and used in a chimney cleaning operation.

Figure 3:
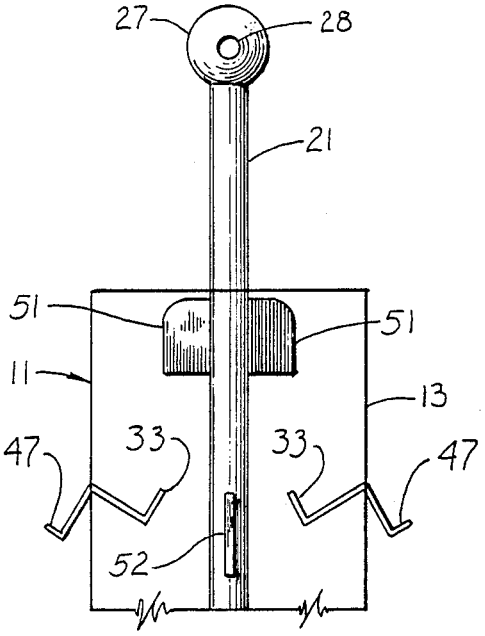
FIGS. 3, 4, 5 and 6 are schematic drawings showing first, second, third, and fourth positions in the cycle operation of the apparatus respectively.

FIG. 3 shows the configuration of the apparatus after a previous chimney cleaning operation with the shaft 21 and the camming plates 51 thereof at an upward position and the arms 33 urged outwardly by the springs 53 (not shown).

Only the top half of the frame 13 is shown in FIGS. 3 through 6 since the operation of the lower half of the apparatus will be similar and can be readily understood from the explanation of the upper half of the apparatus.

Figure 4:
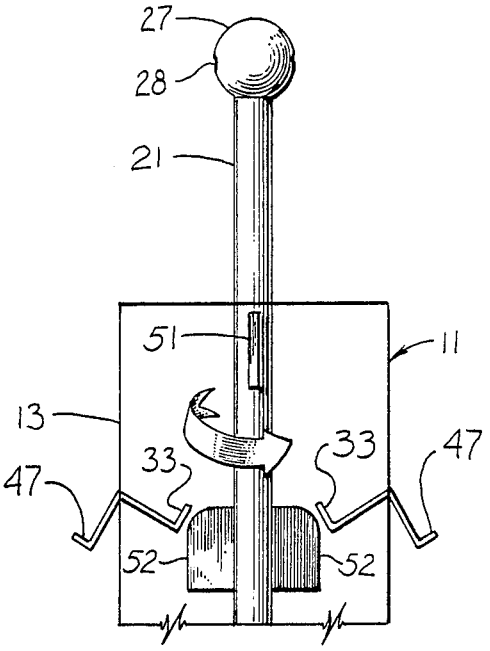

FIG. 4 shows the configuration of the apparatus partially prepared for operation wherein the shaft 21 and the camming plates 51 have been rotated 90° and are ready to be lowered so that the camming plate 51 is below the arms 33.

Figure 5:
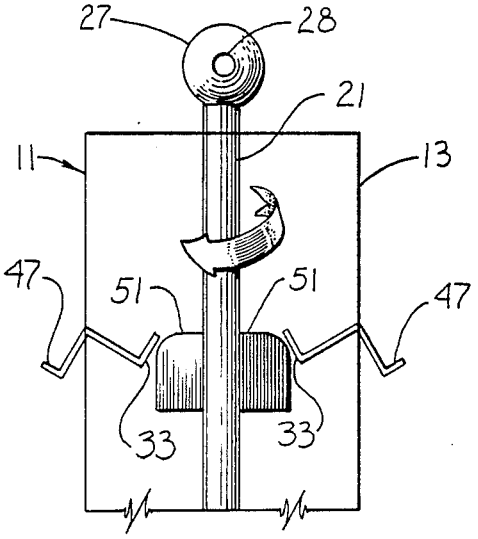
Figure 6:
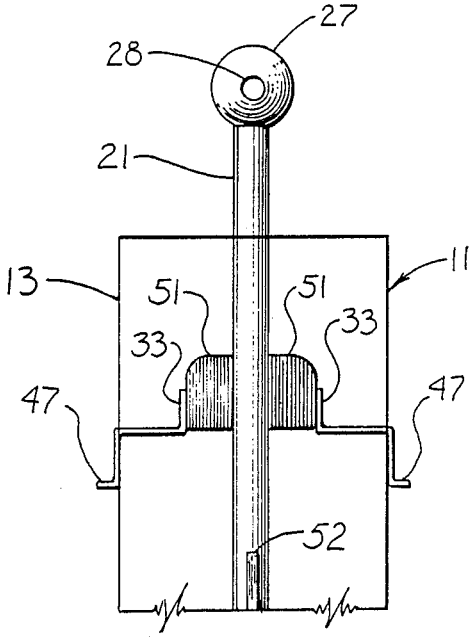

FIG. 5 shows the configuration after the shaft 21 and the camming plates 51 have been rotated back to the orientation shown in FIG. 3. FIG. 6 shows the configuration fully prepared for operation with the shaft 21 raised partially to cause the camming plates 51 to pivot the arms 33 causing retraction of the blades 47 so that the cleaning apparatus may readily be lowered into the chimney flue.

The frictional forces of the arms 33 on the camming plates 51 as shown in FIG. 6 are sufficient to prevent the weight of the apparatus from causing the shaft 21 to slide upward relative to arms 33. The friction or sliding resistence of the arms 33 on the camming plates 51 may be increased as necessary to insure this condition by providing serrations or detents on the camming plates 51, or by other known expedients. At the same time the frictional forces between the arms 33 and the camming plates 51 are low enough that forces somewhat greater than that due to the weight of the apparatus will pull the shaft 21 upwardly to lift the camming plates 51 completely past the arms 33 causing the apparatus to assume the configuration shown in FIG. 3.

Accordingly, when the chimney cleaning apparatus has been lowered down the flue while in the configuration shown in FIG. 6, and it is desired to start the upward motion and scraping of the inside walls of the flue, a sharp tug on the rope or cable will apply the additional force necessary to cause the apparatus to assume the configuration shown in FIG. 6, whereupon it is then drawn up the chimney while the blades 47 scrape the interior of the chimney wall.

Normally the creosote, soot and other material scraped from the wall would drop through the open frame 13 to the bottom of the flue where it would be removed by a vacuum cleaner or other conventional means. If desired, a collector in the form of a bag or the like could be secured to the bottom of the frame for collecting most of the removed material. It would be expected, however, that conventional means for clearing the bottom of the flue cavity and/or the fireplace would be required in any case.

If desired the shaft 21 may be arranged so that it is limited to a 90° rotation between the position shown in FIG. 3 and the position shown in FIG. 4 thereby facilitating the manipulation necessary to cock the apparatus in the retracted position.

Figure 7:
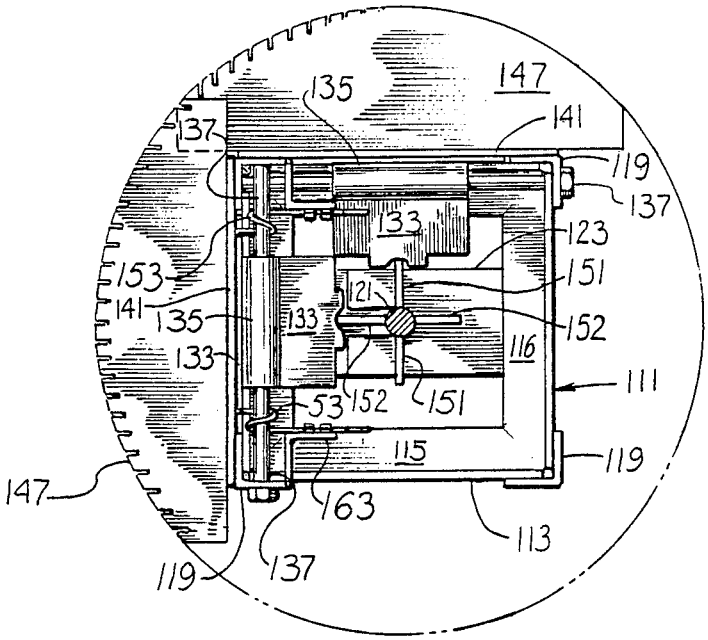
FIG. 7 shows an alternative embodiment of the invention for circular cross-section chimneys in a horizontal sectional view.

FIG. 7 shows an alternative embodiment for cleaning a circular chimney. It may be substantially similar to, or identical to, the apparatus of FIGS. 1 and 2 in most respects except for the blades 147, which are seen to have an arcuate edge to conform to the inner surface of the chimney flue tile or the like. In other respects the apparatus 111 may be similar to the apparatus 11 with arms 133 pivotally supported on long bolt shanks 137 by a bearing portion 135. A shaft 121 performs the same function as the shaft 21 and a camming plates 151 may be substantially the same as the camming plates 51 in FIG. 1.

The blades 147 will have a generally circular outline but may preferably be slightly elliptical to allow for the fact that they are sloped downward in contact with the chimney walls as is the case with the apparatus 11 previously described. It will be seen that adjacent blades 147 at least meet, or slightly overlap, so that the entire periphery of the interior surface of the flue is contacted by and scraped by the blades 147. The blades 147 of the chimney cleaning apparatus 111 will not extend quite the full width of the inner wall of the rectangular or square chimney flue because some allowance must be made for clearance of the apparatus while being lowered down the chimney.

The blades 147 of the cleaning apparatus 111 are preferably provided with slots or serrations to render the outer edges of the blades more flexible. This will help to accommmodate any difference in the curvature of the blade as it meets the interior surface of the chimney wall 100.

Figure 8:
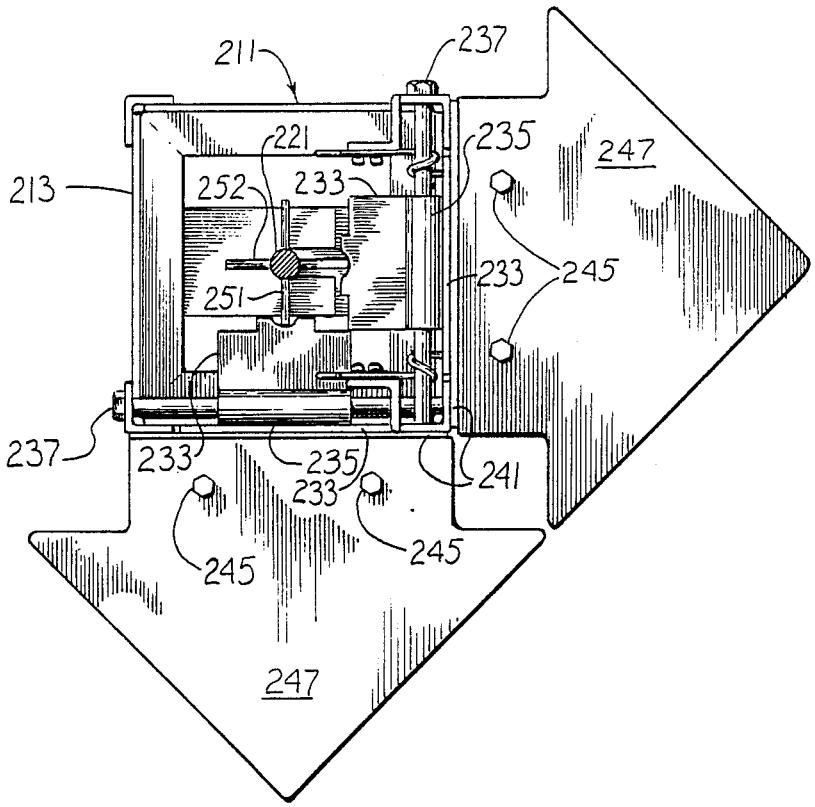
FIG. 8 shows another alternative embodiment of the invention with triangular blades.

FIG. 8 shows a third embodiment of the invention wherein blades 247 are of triangular shape, and a frame 213 is lowered into the chimney with its sides rotated 45° with respect to the walls of a square chimney flue. The apex of each blade 247 accordingly is directed to a corner of the chimney flue with the result that residue is very effectively cleaned out of the flue corners. The blades 247 may have an apex angle of slightly less than 90° so that the slightly downwardly sloped blades will effectively reach into the corners of the chimney flue. Serrations may be provided in the blades 247 to give flexibility and better contact between the blade and the flue sidewall.

The outer ends of the adjacent blades 247 are shown in FIG. 8 with their projection on a horizontal plane substantially meeting, thereby covering the entire inner surface of the flue in the scraping and cleaning operation. In fact, the blades 247 may slightly overlap (in their horizontal plane projection) and yet not interfere because of their vertical displacement on the frame 213. The operation and construction of the cleaning apparatus 211 may be substantially the same as that of the cleaning apparatus 11, except that it will be noted that frame 213 has a horizontal cross-section with dimensions relatively small compared to the interior of the chimney flue with which it is to be used. With the understanding the shaft 221 will be similar to the shaft 21, the camming plates 251 similar in operation to the camming plates 51, and the arms 233, the bearings 235 and the bolts shanks 237 will be substantially similar to the corresponding elements 33, 35 and 37 in FIG. 1. The blades 247 may be mounted by the bolts 245, or other means, to mounting plates 241, and in some cases it may be possible to use blades similar to 247 with the cleaning apparatus 11 of FIG. 1 or cleaning apparatus 111 of FIG. 7 for cleaning a large flue without employing a large frame 13. Of course, if blades such as 247 are to be used in apparatus 211 for a small chimney flue, the frame 213 must be relatively small also, as previously explained.

Figure 2:
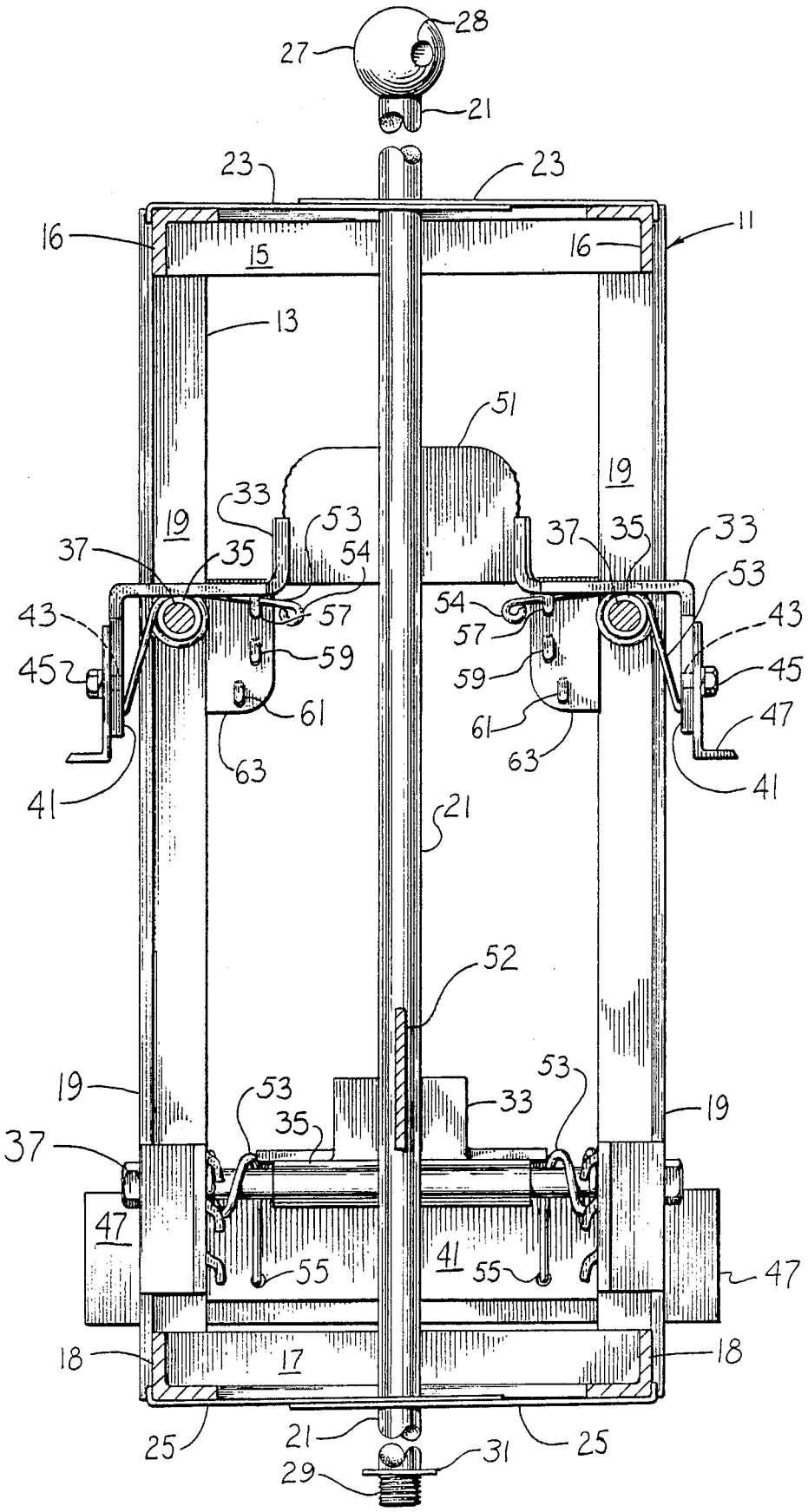
FIG. 2 is a vertical sectional view taken along the line indicated by the arrows in FIG. 2.
Figure 9:
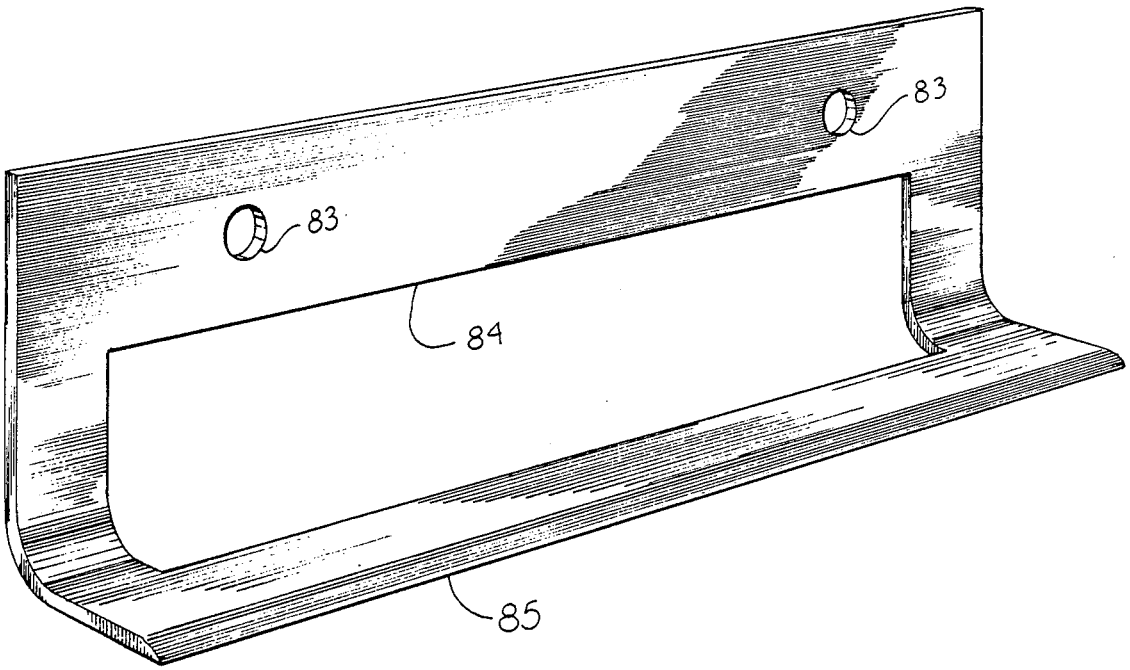
FIG. 9 shows an alternative form of scraper blade specially adapted for scraping fresh mortar from joints in a chimney under construction.

FIG. 9 shows an alternative form of blade primarily for use with the apparatus 11 of FIGS. 1 and 2, and particularly useful for cleaning fresh mortar from the interior of a chimney. A mortar cleaning blade 81 is provided with holes 83 so that it may be mounted on the mounting plate 41 in a manner similar to that shown for blade 47 in FIG. 1. A large generally rectangular opening 84 is cut out of the blade 81 to allow mortar to drop through rather than piling up on the blade. The curved edge 85 of the blade serves to shear off the fresh mortar and to smooth the joint between flue tiles to provide particularly smooth interior surface in the chimney for easier maintenance and greater efficiency.

The chimney cleaner apparatus 11, or other embodiments, can be adapted to be used as a pick-up tool for flue tile and would be useful in chimney construction or in taking down a chimney. To adapt the cleaning apparatus 11 one would start by removing the ball 27 from the threads 21 and engaging it on threads 29 at the bottom of shaft 21.

For use as a pick-up tool in the inverted position, the blades 47 would preferably be replaced by blades formed of hard rubber or similar stiffly resilient plastic material, or a portion of such hard rubber strip would be secured to the outer edge of the blades, possibly in the form of a boot. The springs 53 would be set for minimum spring pressure and allowed to extend as shown in FIG. 3.

After the cleaning apparatus 11 was lowered down the flue tile it would then be pulled in an upward direction by the action of the rope or cable on the shaft 21, whereupon the camming plates 51 would bear on the arms 33 creating pressure between the extended hard rubber blades and the walls of the flue tiles. The hard rubber blades could be of a shape similar to the straight blades 47 of FIGS. 1 and 2, the arcuate blades 147 of FIG. 7, or the triangular blades 247 of FIG. 8.

It should be noted that the frame 13, 113, or 213 could be formed of a material other than steel, for example, aluminum or plastic, and that the blades 47 and other forms of the blades may be formed of materials other than steel or hard rubber, and may have different degrees of flexibility in order to suit the particular application for which they are intended. Also the blades may be formed in part of one material and in part of a different material, combining plastic and metal, for example. While the blades 47 are shown with a sharp scraping or cutting edge, the blade edge may simply be ground at a right angle to the surfaces of the blade; any of the many conventional scraping or cutting blade configurations may be adapted to be used in the chimney cleaning apparatus of the invention.

The bearings, springs, etc., of the working parts of the invention are generally conventional in form and may be replaced by equivalent means for accomplishing the purposes which they serve. This is also true of the cam and follower functions of the camming plates 51 and the arms 33.

In addition to the variations and modifications to the invention shown, described or suggested above, other variations and modifications will be apparent to those of ordinary skill in the art and the scope of the invention is not to be considered limited to the particular embodiments and variations shown or suggested, but is rather to be determined by reference to the appended claims.

What is claimed is:

1. Chimney flue cleaning apparatus comprising a frame, a pair of oppositely disposed outwardly extending arms pivotally mounted to said frame for limited rotational movement about respective horizontal axes, blade elements on said arms, each having a shape adapted to conform to the inside surface of a chimney flue, means for urging said arms to a piston with said blade elements outwardly extended, retraction means interacting with said arms to hold said blade elements in a non-extended position, said retraction means including a vertical central shaft in said frame having camming plates secured thereto with contact a portion of said arms to retract and hold them in a non-extended position, and means for suspending said frame to be lowered into a chimney flue and for disabling said retraction means while said frame is suspended within said flue.

2. Apparatus as recited in claim 1 wherein said blade elements have a substantially straight edge shape parallel to a respective one of said horizontal axes.

3. Apparatus as recited in claim 1 wherein said blade elements have an arcuate edge shape.

4. Apparatus as recited in claim 1 wherein said blade elements have a triangular shape with the edges at substantially 45° to a respective one of said horizontal axes.

5. Chimney flue cleaning apparatus comprising a frame, a first pair of oppositely disposed outwardly extending arms pivotally mounted to said frame for limited rotational movement about respective parallel horizontal axes, a second pair of oppositely disposed outwardly extending arms pivotally mounted to said frame for limited rotational movement about respective horizontal axes in planes substantially perpendicular to the first said horizontal axes, the first said horizontal axes being vertically displaced respectively from the second and horizontal axes, blade elements on said arms, each having a shape adapted to conform to the inside surface of a chimney flue, means for urging said arms to a position with said blade elements outwardly extended, retraction means interacting with said arms to hold them in a non-extended position, said retraction means including a vertical central shaft in said frame having camming plates secured thereto which contact a portion of said arms to retract and hold them in a non-extended position, and means for suspending said frame to be lowered into a chimney flue and for disabling said retraction means while said frame is within said flue.

6. Apparatus as recited in claim 5 wherein said blade elements have a substantially straight edge shape parallel to a respective one of said horizontal axes.

7. Apparatus as recited in claim 5 wherein said blade elements have an arcuate edge shape.

8. Apparatus as recited in claim 5 wherein said blade elements have a triangular shape with the edges at substantially 45° to a respective one of said horizontal axes.

9. Apparatus as recited in claim 5 wherein said arms are provided with blade mounting plates and said blade elements are removably mounted on said mounting plates.

10. Chimney flue cleaning apparatus comprising a frame, a first pair of oppositely disposed outwardly extending arms pivotally mounted to said frame for limited rotational movement about respective first and second horizontal axes, a second pair of oppositely disposed outwardly extending arms pivotally mounted to said frame for limited rotational movement about respective third and fourth horizontal axes in planes substantially perpendicular to said first and second horizontal axes, said first and second horizontal axes being vertically displaced from said third and fourth horizontal axes, blade elements on the outer ends of said arms and having an edge shape adapted to conform to the inside surface of a chimney flue, means for urging said arms to a position with said blade elements outwardly extended, retraction means including camming elements interacting with said arms to rotate them to a non-extended position, said retraction means further including a vertical centrally located shaft in said frame on which said camming elements are mounted, there being one camming element for each said arm and the camming elements having arcuate surfaces causing rotation of said arms as said shaft is raised relative to said frame, and means for suspending said frame to be lowered into a chimney flue and for deactivating said retraction means while said frame is suspended with said flue.

* * * * *

UNITED STATES PATENT AND TRADEMARK OFFICE

CERTIFICATE OF CORRECTION

PATENT NO. : 4,757,573

DATED : July 19, 1988

INVENTOR(S) : Richard Brophy

It is certified that error appears in the above-identified patent and that said Letters Patent are hereby corrected as shown below:

On first page, at FILED: change "Jul. 19, 1987" to --June 19, 1987--.

In Column 5, line 52, change "the" to --this--.

In Column 7, line 6, change "piston" to --position--.

In Column 7, line 12, change "with" to --which--.

In Column 7, line 39, change "and" to --said--.

Signed and Sealed this

Twenty-fourth Day of January, 1989

*Attest:*

*Attesting Officer*

DONALD J. QUIGG

*Commissioner of Patents and Trademarks*